US007360605B2

(12) United States Patent
Thompson et al.

(10) Patent No.: US 7,360,605 B2
(45) Date of Patent: Apr. 22, 2008

(54) THERMALLY PROTECTED RESERVOIR FOR ONBOARD FIRE SUPPRESSION SYSTEM

(75) Inventors: Robert Thompson, Redford, MI (US); Joseph Dierker, Jr., Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/621,585
(22) Filed: Jan. 10, 2007

(65) Prior Publication Data
US 2007/0119604 A1 May 31, 2007

Related U.S. Application Data
(63) Continuation-in-part of application No. 10/907,134, filed on Mar. 22, 2005, now Pat. No. 7,198,111.

(51) Int. Cl.

| | |
|---|---|
| ***A62C 3/07*** | (2006.01) |
| ***A62C 35/00*** | (2006.01) |
| ***A62C 13/22*** | (2006.01) |
| ***B65D 1/40*** | (2006.01) |
| ***B65D 8/04*** | (2006.01) |
| ***B65D 90/22*** | (2006.01) |
| ***F17C 1/00*** | (2006.01) |

(52) U.S. Cl. ..... 169/9; 169/62; 169/84; 220/62.22; 220/88.1; 220/560.01

(58) Field of Classification Search ..... 169/9, 169/62, 84, 5, 16, 26, 54, 56, 71, 75, 85; 220/62.22, 88.1, 560.01, 62.11, 62.15, 62.19, 220/562, 660; 239/373, 337, 172
See application file for complete search history.

(56) References Cited

U.S. PATENT DOCUMENTS

| | | | | |
|---|---|---|---|---|
| 5,108,832 | A | 4/1992 | Nugent, Jr. et al. | |
| 5,984,126 | A * | 11/1999 | Gordon | 220/62.22 |
| 5,992,528 | A * | 11/1999 | Parkinson et al. | 169/6 |
| 6,371,213 | B1 * | 4/2002 | Smith et al. | 169/73 |
| 6,702,033 | B1 * | 3/2004 | Mitchell et al. | 169/85 |
| 2003/0150625 | A1 * | 8/2003 | Smith et al. | 169/56 |

OTHER PUBLICATIONS

Curran, Sullivan D., P.E., Transfer Technology-Fire Resistant Fiberglass Pipe; http://www.fiberglasstankandpipe.com/transfer.htm, 2004.

* cited by examiner

*Primary Examiner*—Darren Gorman
(74) *Attorney, Agent, or Firm*—Frank MacKenzie; Dickinson Wright PLLC

(57) ABSTRACT

An automotive vehicle includes a vehicle body and at least one reservoir containing a fire suppressant agent. A distribution system receives the fire suppression agent from the reservoir and conducts the agent to at least one location about the vehicle's body in response to the determination by a sensor system and controller that the vehicle has been subjected to a significant impact. The reservoir is protected by a thermal protection barrier applied to the reservoir's outer surface, excluding the base of a pyrotechnic propellant.

6 Claims, 9 Drawing Sheets

THERMALLY PROTECTED RESERVOIR FOR ONBOARD FIRE SUPPRESSION SYSTEM

RELATED APPLICATIONS

The present application is a continuation-in-part of U.S. patent application Ser. No. 10/907,134, filed on Mar. 22, 2005 now U.S. Pat. No. 7,198,111.

BACKGROUND OF THE INVENTION

1. Field of the Invention

The present invention relates to an automotive vehicle having an onboard apparatus for suppressing a vehicle fire.

2. Disclosure Information

Police vehicles are subject to increased exposure to collisions, particularly high-speed rear-end collisions, arising from the need for police officers to stop on the shoulders, or even in the traffic lanes, of busy highways. Unfortunately, other motorists are known to collide with police vehicles employed in this manner. These accidents can compromise the fuel system of any vehicle, and may cause fires. The present system is designed to suppress the spread of, or potentially, to extinguish such a fire. U.S. Pat. No. 5,590,718 discloses an anti-fire system for vehicles in which a number of fixed nozzles are furnished with a fire extinguishing agent in response to an impact sensor. The system of the '718 patent suffers from a problem in that the fixed nozzles are not suited to the delivery of the extinguishing agent at ground level. Also, the '718 patent uses a valving system which could become clogged and therefore inoperable. U.S. Pat. No. 5,762,145 discloses a fuel tank fire protection device including a powdered extinguishing agent panel attached to the fuel tank. In general, powder delivery systems are designed to prevent ignition of fires and are deployed upon impact. As a result, the powder may not be able to follow the post-impact movement of the struck vehicle and may not be able to prevent the delayed ignition or re-ignition of a fire.

The present fire suppression system provides significant advantages, as compared with prior art vehicular fire suppression systems.

SUMMARY OF THE INVENTION

According to one aspect of the present invention, a fire suppression system for a vehicle includes at least one reservoir containing a fire suppressant agent, and a propellant, operatively associated with the reservoir, for expelling the fire suppressant agent from the reservoir. A distribution system receives fire suppressant agent expelled from the reservoir and distributes the depressant agent in at least one location external to the vehicle. A thermal protection barrier is applied to the reservoir. This barrier preferably comprises an intumescent coating applied to an outer surface of the reservoir. Intumescent coating may comprise either an epoxy-based coating, or a latex-based coating.

According to another aspect of the present invention, a reservoir may be configured as a resin-based filament wound vessel having the previously described intumescent material incorporated within the resin used in the construction of the vessel.

According to another aspect of the present invention, an intumescent material suitable for use according to this invention includes polyepoxide resin, zinc, boron, and phosphorus, with the material being adapted to produce an expansion in response to a thermal excursion in excess of a predetermined threshold.

According to another aspect of the present invention, a propellant used in the present onboard fire suppression system may be configured as a pyrotechnic device.

According to another aspect of the present invention, an intumescent coating used with this invention is preferably applied to an external surface of the reservoir, excluding a propellant base extending through a wall of the reservoir.

It is an advantage of a fire suppression system according to the present invention, that the fire suppressant reservoir is adapted to withstand substantial thermal excursions, and to respond to such excursions in a controlled manner.

It is another advantage of a onboard fire suppression system according to the present invention that externally applied heat will be caused to channel into a propellant device, so as to cause controlled activation of propellant device before the walls of the reservoir become thermally impaired.

Other advantages, as well as features of the present invention will become apparent to the reader of this specification.

DETAILED DESCRIPTION OF THE PREFERRED EMBODIMENT

Figure 1:
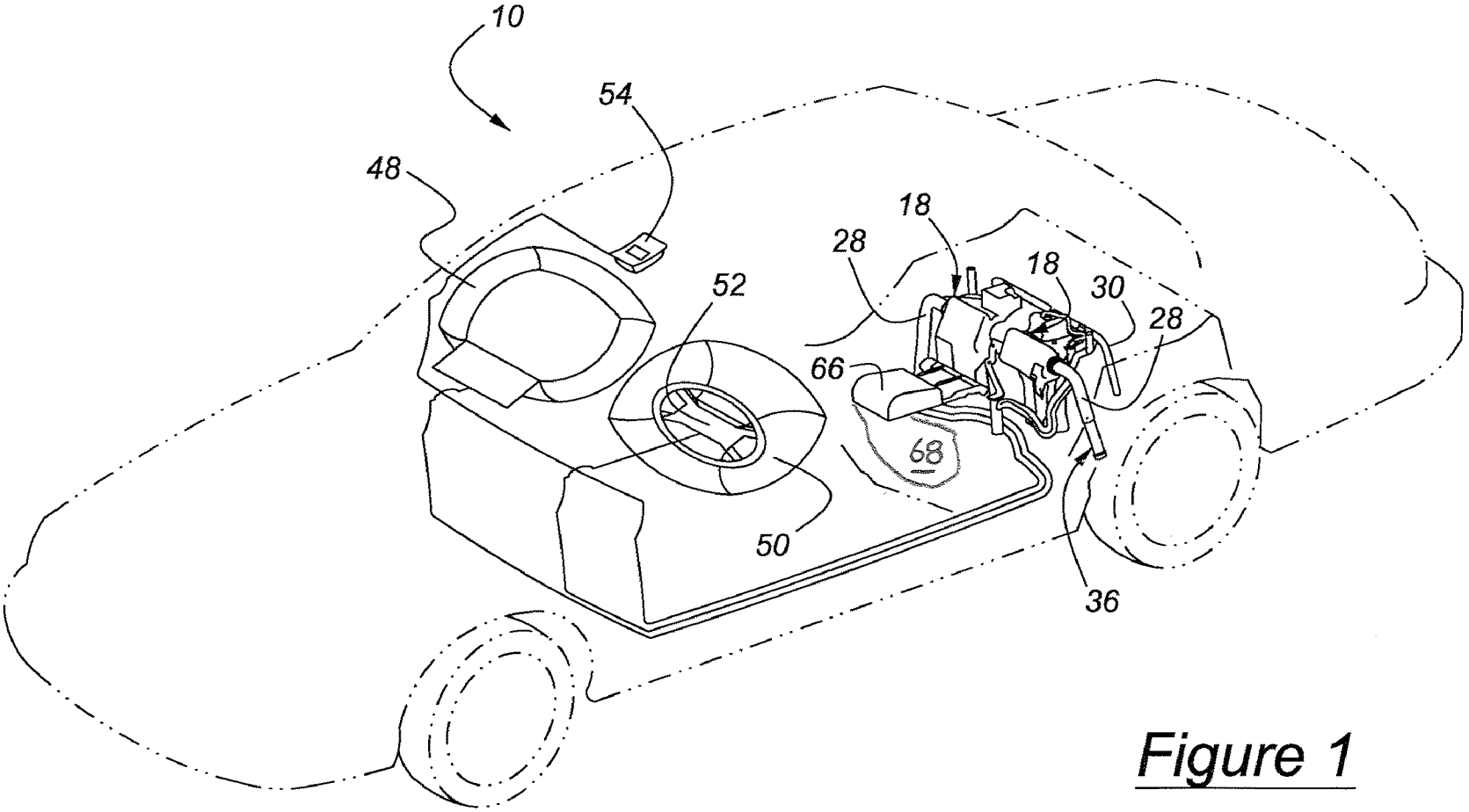
FIG. 1 is a ghost perspective view of an automotive vehicle having a fire suppression system according to the present invention.

As shown in FIG. 1, vehicle 10 has a passenger airbag restraint 48 and a driver's airbag restraint 50 mounted adjacent steering wheel 52. A fire suppression system includes controller 66 which is mounted upon floor pan 68 of vehicle 10, and reservoirs 18 which are mounted under floor pan 68 in the so-called kick-up area adjoining the rear axle of vehicle 10. Those skilled in the art will appreciate in view of this disclosure that additional passenger restraint devices, such as seat belt pretensioners and side airbags, may be installed in a vehicle and controlled at least in part by, or in conjunction with, controller 66.

Figure 2:
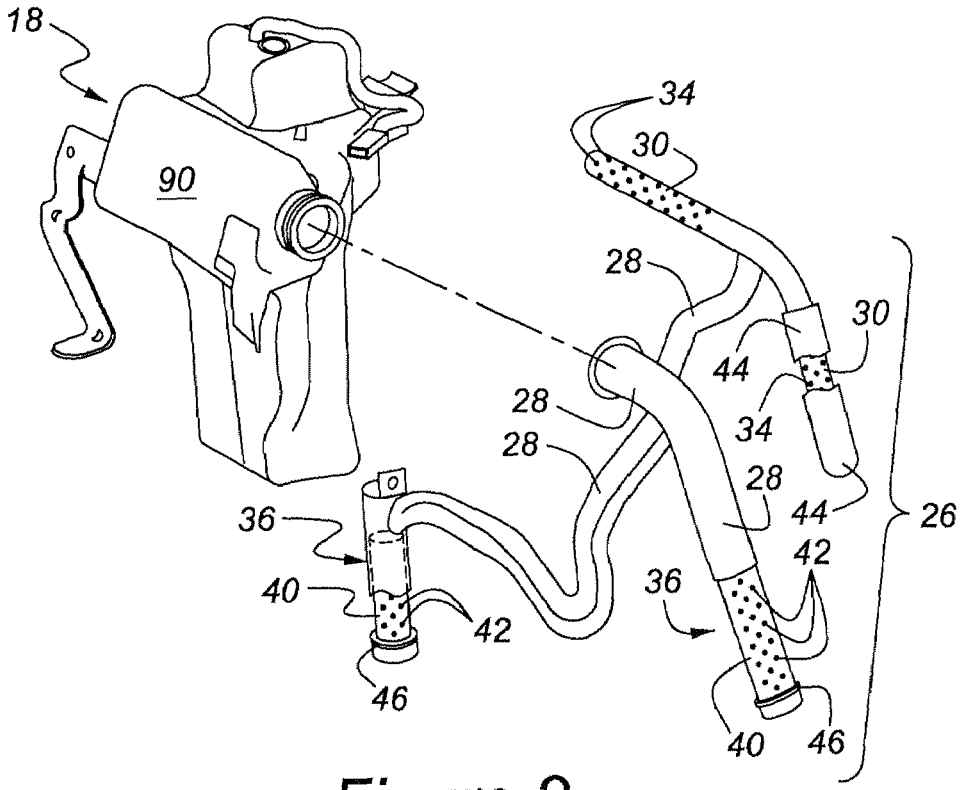
FIG. 2 is an exploded perspective view of a portion of a fire suppression system according to the present invention.
Figure 8:
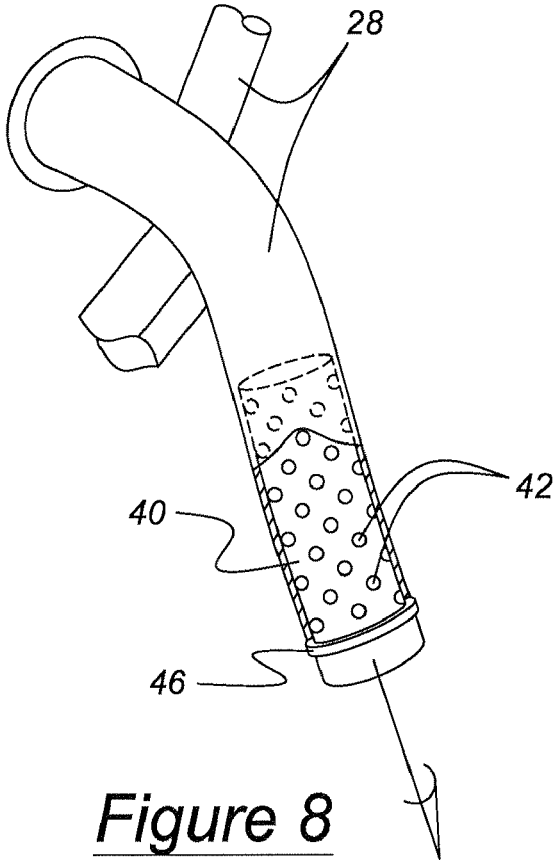
FIG. 8 is a perspective view of a variable geometry fire suppression agent nozzle according to one aspect of the present invention.

FIG. 1 shows not only reservoirs 18, but also a portion of right and left side fire suppression conduits 28, as well as fixed geometry nozzles 30 and variable geometry nozzles 36. As seen in FIG. 1, variable geometry nozzles 36 project downwardly to allow fire suppression agent to be expelled from reservoirs 18 and placed at a low angle to the ground surface the vehicle is operating upon. This mode of operation is possible because variable geometry nozzles 36 are, as shown in FIG. 2, telescopingly extensible. This telescoping feature, which is shown in greater detail in FIG. 8, is produced by a sliding spray head, 40, which is slidingly engaged with conduit 28 such that gas pressure within conduit 28 forces spray head 40 downwardly into its extended position, causing fire suppression agent 22 to be discharged through a number of holes 42 formed in spray head 40. As shown in FIG. 2, at least two variable geometry nozzles 36 may be employed with single reservoir 18, along with at least two fixed nozzles 30 which are spray bars each having a number of orifices 34. While in their normally closed state, variable geometry nozzles 36 are liquid-tight by virtue of seals 46, which are interposed between an end of each of spray heads 40 and the corresponding ends of conduits 28. In a preferred embodiment, seals 46 comprise elastomeric boots attached to an outer surface of conduit 28. Seals 46 are simply sheared by the deploying spray head 40 when the present system is discharged. Fixed nozzles 30 are also rendered liquid-tight by covers 44, which are simply blown off when the present system is discharged. The sealing of nozzles 30 and 36 is important, because this prevents the ingress of road splash, which could block the system in sub-freezing weather or cause corrosion or blockage due to mud or other foreign matter.

Figure 7:
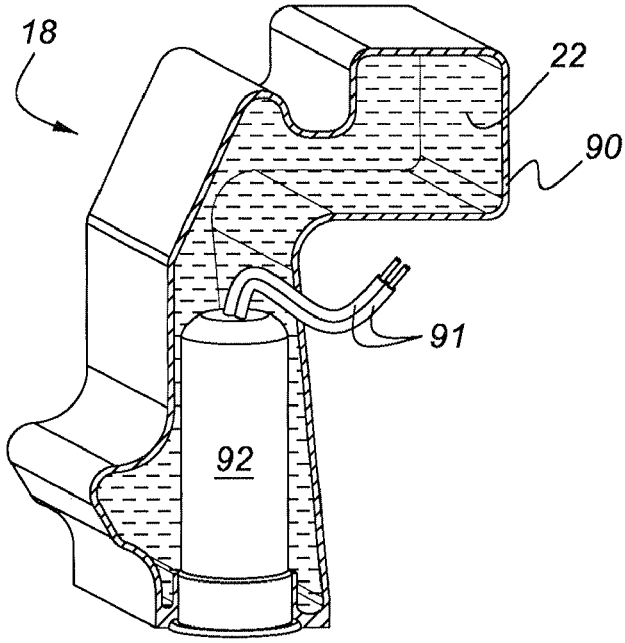
FIG. 7 is a cutaway perspective view of a fire suppression agent reservoir according to one aspect of the present invention.

Additional details of reservoir 18 are shown in FIG. 7. Tank 90 contains approximately 1.5 L of fire suppression agent 22, and a propellant 92. Propellant 92 includes two squibs (not shown) which are activated simultaneously by controller 66 via lines 91 so as to release a large amount of gas, forcing fire suppressant agent 22 from tank 90 and into distribution system 26, including conduit 28 and the various fixed and variable geometry nozzles. A preferred propellant, marketed by Primex Aerospace Company as model FS01-40, is a mixture including aminotetrazole, strontium nitrate, and magnesium carbonate. This is described in U.S. Pat. No. 6,702,033, which is hereby incorporated by reference into this specification.

Those skilled in the art will appreciate in view of this disclosure that other types of propellants could be used in the present system, such as compressed gas canisters and other types of pyrotechnic and chemical devices capable of creating a gas pressure force in a vanishingly small amount of time. Moreover, fire suppressant agent 22, which preferably includes a water-based solution with hydrocarbon surfactants, fluorosurfactants, and organic and inorganic salts sold under the trade name LVS Wet Chemical Agent® by Ansul Incorporated, could comprise other types of agents such as powders or other liquids, or yet other agents known to those skilled in the art and suggested by this disclosure. If two reservoirs 18 are employed with a vehicle, as is shown in FIG. 1, all four squibs will be deployed simultaneously.

Figure 4:
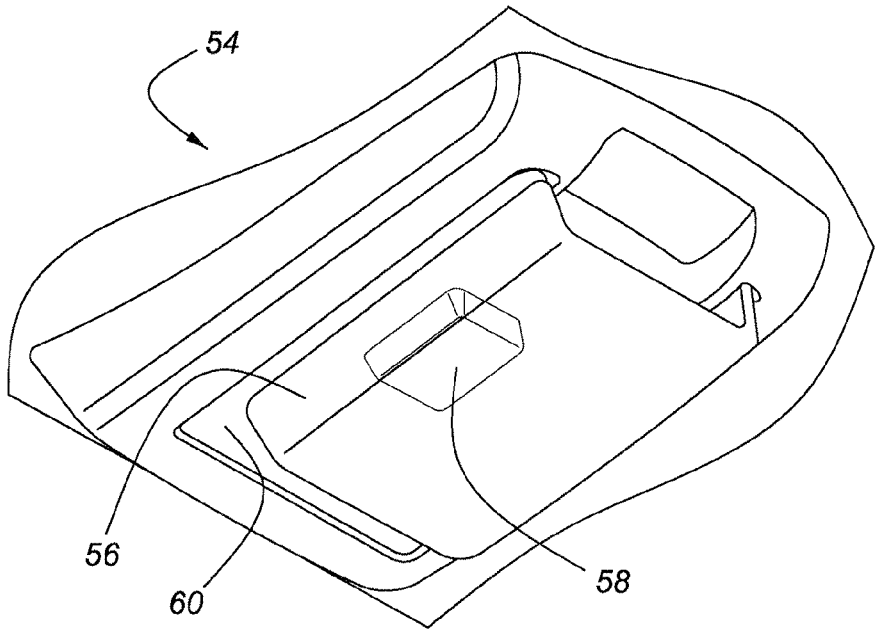
FIG. 4 is a perspective view of a manually activatable switch used with a fire suppression system according to the present invention.

FIG. 4 shows manually activatable switch 54 for use with the present system. As shown in FIG. 1, switch 54 may be advantageously located on the headliner of vehicle 10 between the sun visors, or at any other convenient position. To use this switch 54, hinged clear cover 56 is first opened by pressing on cover 56. Thereafter, the fire suppression system may be triggered by manually pressing pushbutton 58. If the vehicle occupants are not disposed to release cover 56, the system may be triggered by merely sharply depressing cover 56, thereby closing contacts (not shown) contained within platform 60.

Figure 3:
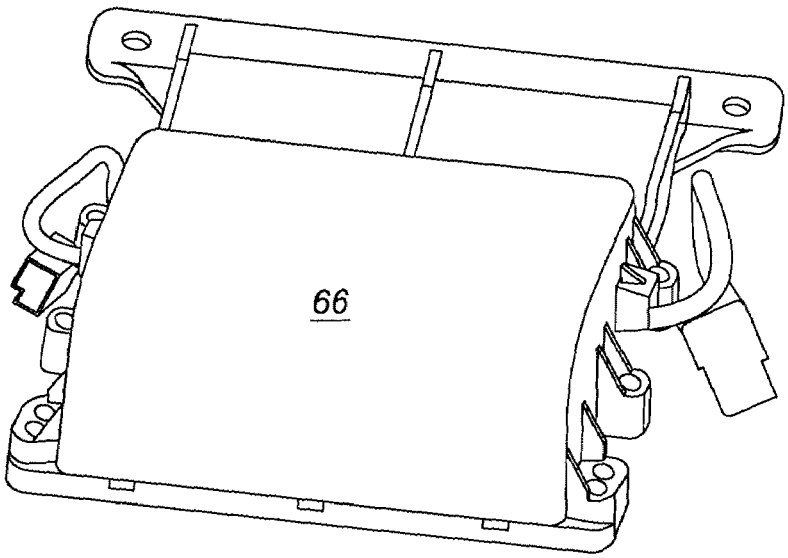
FIG. 3 is a perspective view of a control module used with a system according to the present invention.
Figure 5:
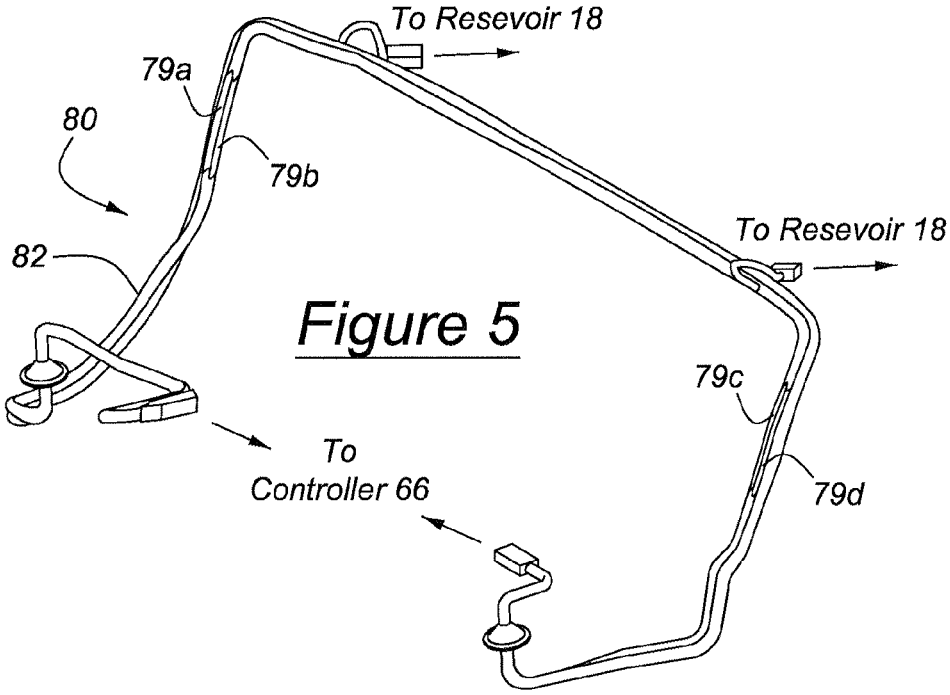
FIG. 5 illustrates a portion of a wiring harness used with the present system.

Because the present system is intended for use when the vehicle has received a severe impact, controller 66, which is shown in FIG. 3, contains a redundant power reserve or supply, which allows operation of the fire suppression system for about nine seconds, even if controller 66 becomes isolated from the vehicle's electrical power supply. Wiring harness 80, as shown in FIG. 5, is armored, and has a para-aramid fiber inner sheath, 82, of about 2 mm in thickness, which helps to shield the conductors within harness 80 from abrasion and cutting during a vehicle impact event. This para-aramid fiber is sold under the trade name KEVLAR® by the DuPont Company. This armoring helps to assure that communication between controller 66 and reservoirs 18 remains in effect during an impact event. Post-impact communications are further aided by redundancy in the control system. Specifically, four independent sets of primary conductors, 79*a-d*, extend from controller 66 to reservoirs 18 protected by sheath 82. Moreover, an H-conductor, shown at 81 in FIG. 5, extends between reservoirs 18. Thus, if one or both of the primary conductors 79*a-b*, or 79*c-d*, extending to one of reservoirs 18 should become severed, H-conductor 81 will be available to carry the initiation signal from the undamaged lines to both of reservoirs 18.

Figure 9:
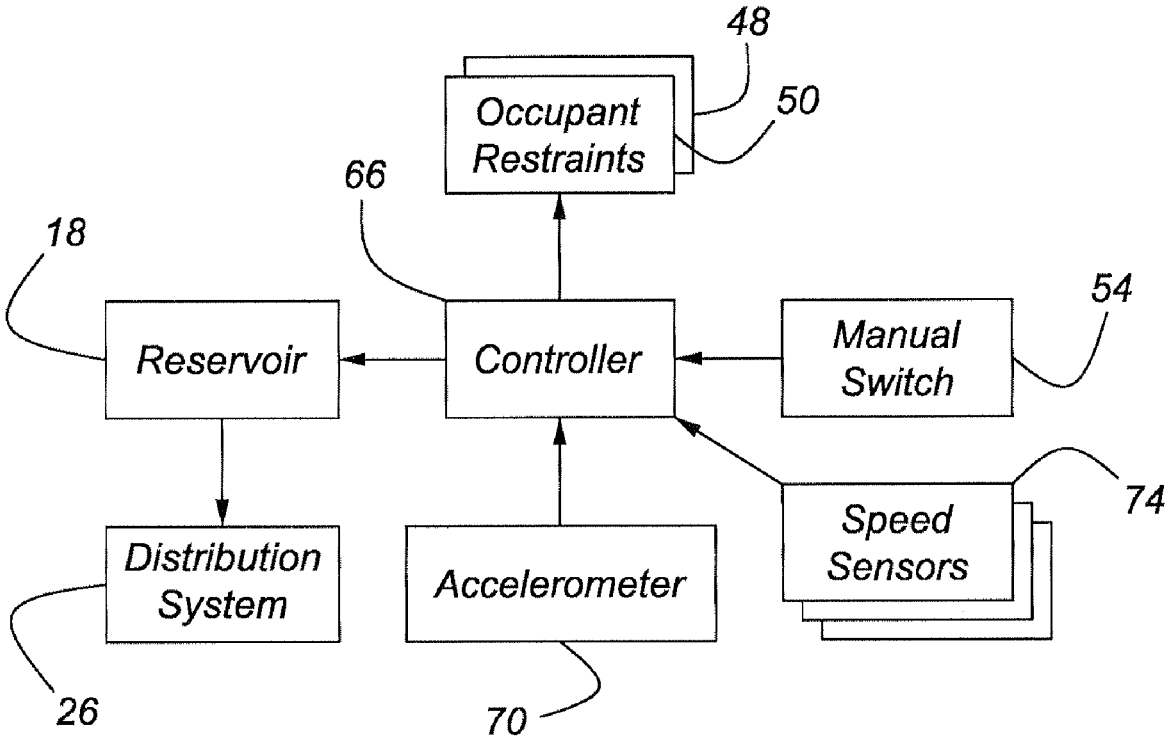
FIG. 9 is a block diagram of a fire suppression system and with additional components for occupant restraint according to one aspect of the present invention.

As noted above, an important feature of the present invention resides in the fact that the control parameters include not only vehicle impact, as measured by an accelerometer such as that shown at 70 in FIG. 9, but also vehicle speed, as measured by means of speed sensors 74, also shown in FIG. 9. Speed sensors 74 may advantageously be existing sensors used with an anti-lock braking system or vehicle stability system. Alternatively, speed sensors 74 could comprise a global positioning sensor or a radar or optically based ground-sensing system. Accelerometer 70, as noted above, could be used with a conventional occupant restraint airbag system, thereby maximizing use of existing systems within the vehicle. Advantageously, accelerometer 70 may be an amalgam of two or more accelerometers having differing sensing ranges. Such arrangements are known to those skilled in the art and suggested by this disclosure. At least a portion of the various sensors could either be integrated in controller 66 or distributed about vehicle 10.

Figure 6:
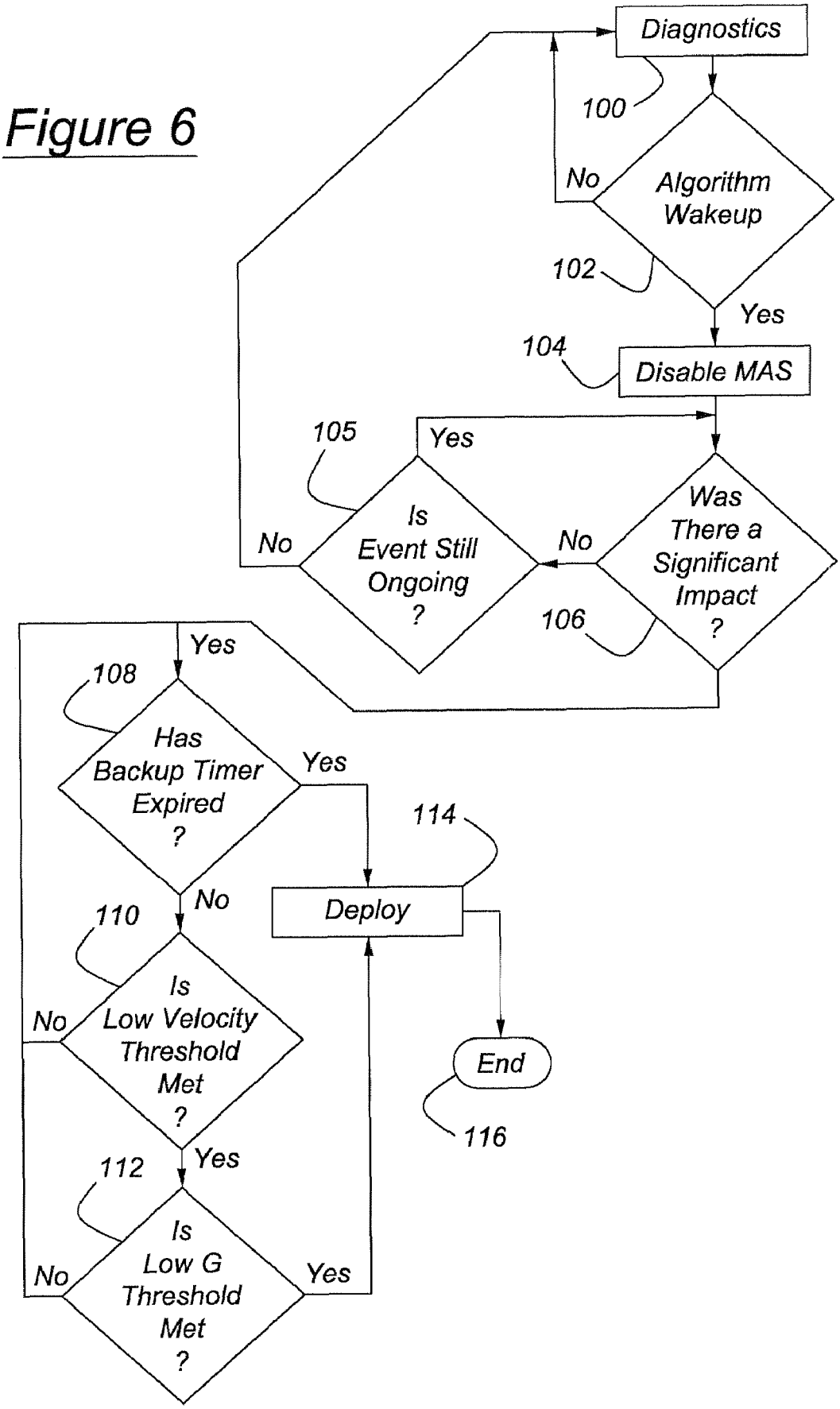
FIG. 6 is a flowchart showing a portion of the logic used to control a system according to the present invention.

FIG. 6 shows a sequence which is used according to one aspect of the present invention for activating a release of fire suppressant agent.

Beginning at block 100, controller 66 performs various diagnostics on the present system, which are similar to the diagnostics currently employed with supplemental restraint systems. For example, various sensor values and system resistances will be evaluated on a continuous basis. Controller 66 periodically moves to block 102, wherein the control algorithm will be shifted from a standby mode to an awake mode in the event that a vehicle acceleration, or, in other words, an impact, having a magnitude in excess of a relatively low threshold is sensed by accelerometer 70. Also, at block 102 a backup timer will be started. If the algorithm is awakened at block 102, controller 66 disables manually activatable switch 54 at block 104 for a predetermined amount of time, say 150 milliseconds. This serves to prevent switch 54 from inadvertently causing an out-of-sequence release of fire suppression agent. Note that at block 104, a decision has not yet been made to deploy fire suppression agent 22 as a result of a significant impact.

At block 106, controller 66 uses output from accelerometer 70 to determine whether there has been an impact upon vehicle 10 having a severity in excess of a predetermined threshold impact value. Such an impact may be termed a significant, or "trigger", impact. If an impact is less severe than a trigger impact, the answer at block 106 is "no", and controller 66 will move to block 105, wherein an inquiry is made regarding the continuing nature of the impact event. If the event has ended, the routine moves to block 100 and continues with the diagnostics. If the event is proceeding, the answer at block 105 is "yes", and the routine loops to block 106.

If a significant impact is sensed by the sensor system including accelerometer 70 and controller 66, the answer at block 106 will be "yes." If such is the case, controller 66 moves to block 108 wherein the status of a backup timer is checked. This timer was started at block 102.

Once the timer within controller 66 has counted up to a predetermined, calibratable time on the order of, for example, 5-6 seconds, controller 66 will cause propellant 92 to initiate delivery of fire suppressant agent 22, provided the agent was not released earlier. Propellant 92 is activated by firing an electrical squib so as to initiate combustion of a pyrotechnic charge. Alternatively, a squib may be used to pierce, or otherwise breach, a pressure vessel. Those skilled in the art will appreciate in view of this disclosure that several additional means are available for generating the gas required to expel fire suppressant agent 22 from tank 90. Such detail is beyond the scope of this invention. An important redundancy is supplied by having two squibs located within each of tanks 90. All four squibs are energized simultaneously.

The velocity of the vehicle 10 is measured at block 110 using speed sensors 74, and compared with a low velocity threshold. In essence, controller 66 processes the signals from the various wheel speed sensors 74 by entering the greatest absolute value of the several wheel speeds into a register. This register contains both a weighted count of the number of samples below a threshold and a count of the number of samples above the threshold. When the register value crosses a threshold value, the answer at block 110 becomes "yes." In general, the present inventors have determined that it is desirable to deploy fire suppression agent 22 prior to the vehicle coming to a stop. For example, fire suppression agent 22 could be dispersed when the vehicle slows below about 15 kph.

At block 112, controller 66 enters a measured vehicle acceleration value into a second register. Thereafter, once the acceleration register value decays below a predetermined low g threshold, the answer becomes "yes" at block 112, and the routine moves to block 114 and releases fire suppressant agent 22. In essence, a sensor fusion method combines all available sensor information to verify that the vehicle is approaching a halt. The routine ends at block 116. Because the present fire suppression system uses all of the available fire suppression agent 22 in a single deployment, the system cannot be redeployed without replacing at least reservoirs 18.

FIG. 6 does not include the activation of occupant restraints 48 and 50, it being understood that known control sequences, having much different timing constraints, may be employed for this purpose. In point of contrast, the low velocity threshold allows the present system to deliver the fire suppression agent while the vehicle is still moving, albeit at a very low velocity. This prevents the rear wheels of the vehicle from shadowing, or blocking dispersion of fire suppressant agent 22. Also, in many cases, a vehicular fire may not become well-established until the vehicle comes to a halt.

Figure 10:
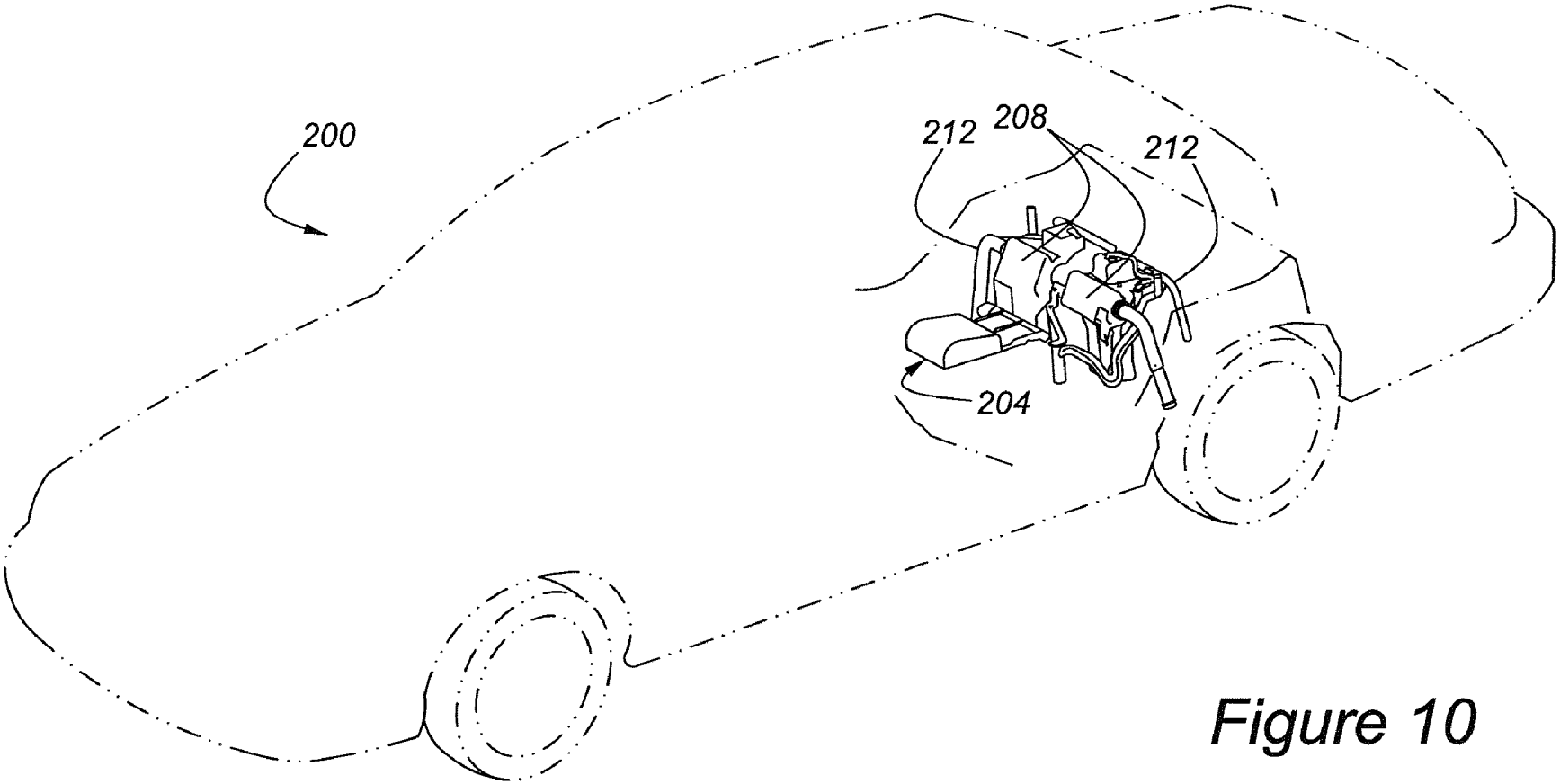
FIG. 10 is a perspective view of a vehicle having a fire suppression agent reservoir according to one aspect of the present invention.

As shown in FIG. 10, vehicle 200, according to an embodiment of the present invention, has controller 204 and onboard fire suppression reservoirs 208. Reservoirs 208 are connected with distribution system 212.

Figure 11:
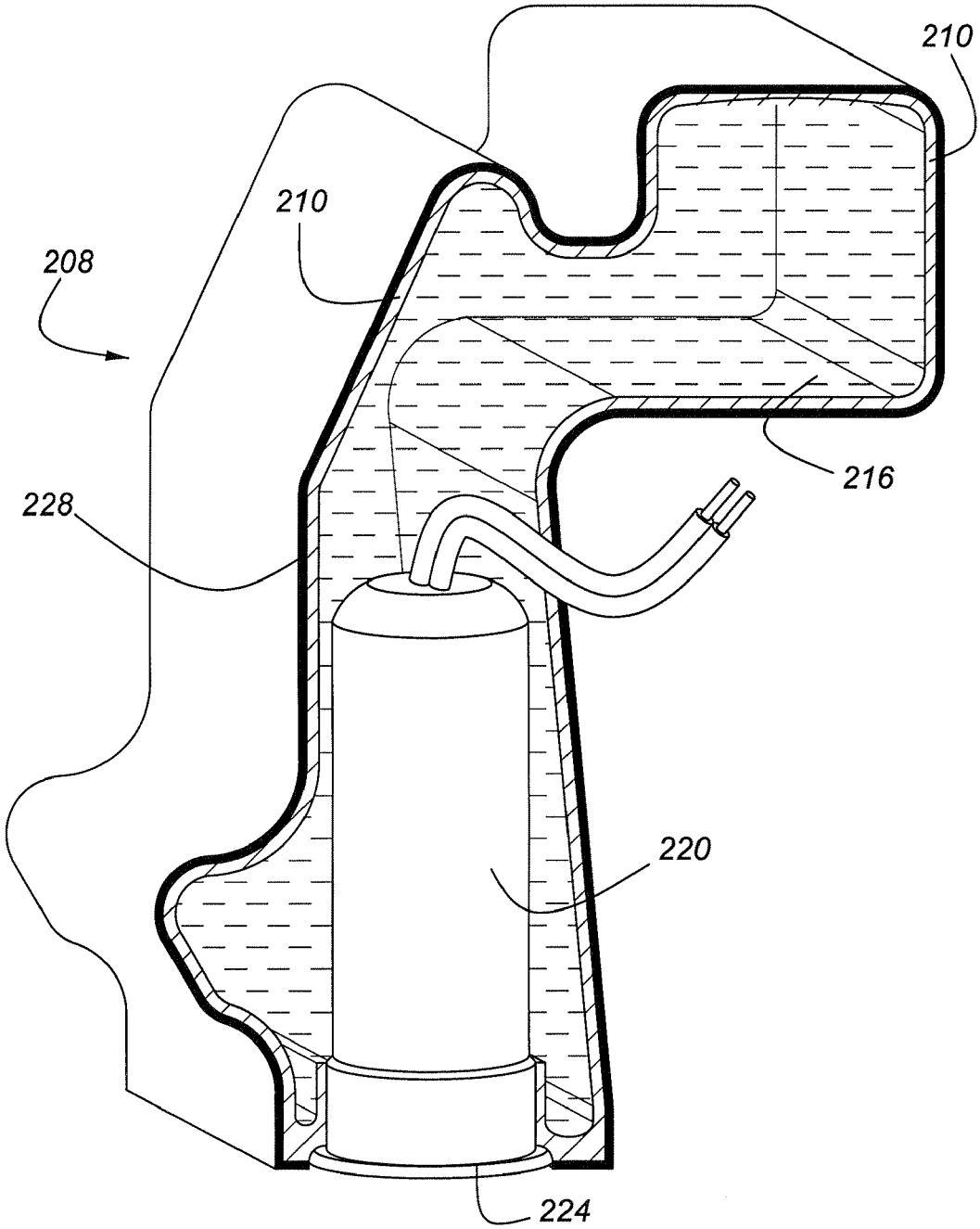
FIG. 11 is a cutaway perspective view of a composite suppression agent reservoir according to one aspect of the present invention, prior to a thermal event.

FIG. 11 shows details of reservoir 208. The reservoir has a wall 210, which is a composite material preferably formed from fiber reinforced resin, which may be embodied as a resin-based filament wound vessel. Reservoir 208 also includes a pyrotechnic propellant device, 220, having a metallic base 224 which extends through the wall 210 of reservoir 208. Reservoir 208 is filled with an aqueous-based fire suppression agent 216. Finally, reservoir 208 is coated with an intumescent coating 228, which is applied to substantially the entire outer surface of reservoir 208, with the exception of base 224 of propellant 220.

Intumescent coatings were first developed in connection with efforts to fireproof buildings. U.S. Pat. No. 5,108,832 discloses an intumescent composition having a resin binder and a flexible polyepoxide resin. The '832 patent is hereby incorporated by reference in its entirety within the specification. In general, successfully employed intumescent coatings have included not only polyepoxide resin, but also zinc, boron and phosphorus. Intumescent coatings have been used in such applications as oil refineries, offshore oil rigs, tankers, and large chemical manufacturing facilities, principally because their ability to reduce thermal transmission to the underlying substrate protects the structural integrity of such substrates in the event of a fire. Known intumescent coatings generally have latex or epoxy bases.

Figure 12:
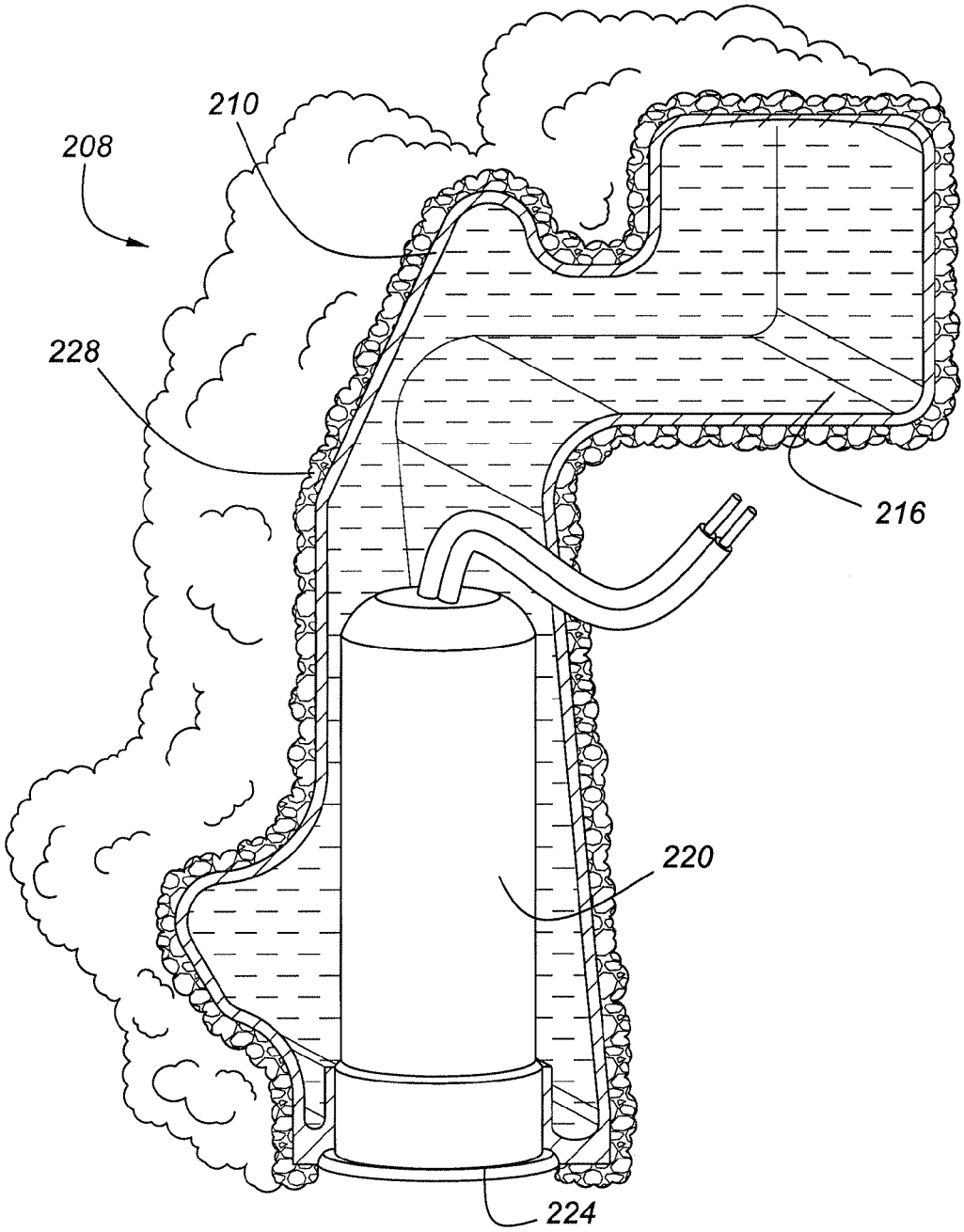
FIG. 12 is a view of the reservoir of FIG. 11, following a thermal event.

Intumescent coatings produce an expansion gas in response to thermal excursions in excess of a predetermined threshold. As a result, the intumescent coating foams to a volume more than ten times its original volume and chars. This result is depicted in FIG. 12. The charred and foamed intumescent coating forms an excellent thermal insulator. Once insulated, reservoir 208 will conduct much less heat through walls 210. Because base 224 is not thermally protected, heat will be channeled through base 224 into propellant 220, and this will cause internal safety igniters within propellant 220 to cause the propellant 220 to fire before walls 210 become thermally impaired.

Those skilled in the art will appreciate in view of this disclosure that other types of intumescent coatings are available and that such coatings have epoxy bases or latex bases. Such coatings have been successfully used in tough environments characterized by the presence of solvents, acids, alkalis, salts, and abrasion.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. An onboard fire suppression system, comprising:

at least one fire suppressant agent reservoir, with said reservoir being constructed of fiber reinforced resin;

a propellant, operatively associated with said reservoir, for expelling the fire suppressant agent from the reservoir, with said propellant comprising a pyrotechnic device having an unprotected base extending through said reservoir;

a distribution system for receiving fire suppressant agent expelled from said reservoir and for distributing the suppressant agent in at least one location external to a vehicle; and an intumescent material applied to said reservoir.

2. An onboard fire suppression system according to claim 1, wherein said intumescent coating is applied to an outer surface of said reservoir.

3. An onboard fire suppression system according to claim 1, wherein said intumescent coating is contained within said resin.

4. An onboard fire suppression system according to claim 1, wherein said intumescent material comprises polyepoxide resin, zinc, boron, and phosphorus, with said intumescent being adapted to produce an expansion gas in response to a thermal excursion in excess of a predetermined threshold.

5. An onboard fire suppression system, comprising:

at least one fire suppressant agent reservoir, with said reservoir being constructed of fiber reinforced resin;

a propellant, operatively associated with said reservoir, for expelling the fire suppressant agent from the reservoir, with said propellant comprising a pyrotechnic device having a base extending through a wall of said reservoir;

a distribution system for receiving fire suppressant agent expelled from said reservoir and for distributing the suppressant agent in at least one location external to a vehicle; and an intumescent coating applied to an outer surface of said reservoir, with said coating being applied such that said base of said pyrotechnic device remains uncoated.

6. An onboard fire suppression system according to claim 5, wherein said base comprises a metallic structure.

* * * * *